US006345475B1

(12) United States Patent
Flory

(10) Patent No.: US 6,345,475 B1
(45) Date of Patent: Feb. 12, 2002

(54) STAIR GUARD

(76) Inventor: Kevin Darnell Flory, 84615 Parkway Rd., Pleasant Hill, OR (US) 97455

( * ) Notice: Subject to any disclaimer, the term of this patent is extended or adjusted under 35 U.S.C. 154(b) by 0 days.

(21) Appl. No.: 09/542,965

(22) Filed: Apr. 4, 2000

(51) Int. Cl.[7] ..... E04F 11/00; E04F 19/10

(52) U.S. Cl. ..... 52/184; 52/182; 52/184; 52/188; 52/185; 256/59; 256/60; 256/65; 256/67; 256/69; 256/73; 256/26; 160/135; 160/160; 160/185; 160/210; 160/351

(58) Field of Search ..... 52/182, 183, 188, 52/184, 185; 256/59, 60, 65, 67, 69, 73, 26; 160/135, 160, 185, 210, 351

(56) References Cited

U.S. PATENT DOCUMENTS 4,122,630 A * 10/1978 Parisien ..... 49/386
5,131,197 A * 7/1992 Varga ..... 52/182
5,667,199 A * 9/1997 Hamm ..... 52/182
5,743,053 A * 4/1998 Somerville ..... 52/182
5,907,935 A * 6/1999 Elena ..... 52/182
6,125,598 A * 10/2000 Lanphier ..... 52/182

* cited by examiner

*Primary Examiner*—Carl D. Friedman
*Assistant Examiner*—Chi Nguyen
(74) *Attorney, Agent, or Firm*—Robert Howard

(57) ABSTRACT

Pivotably mounted barriers extending across a portion of and staggered in an alternating manner from opposite sides and spaced apart as to permit directed travel up or down stairs or staircase. Barriers extend across staircase to the extent that in addition to acting as an aid in ascending or descending, should a person stumble or lose their footing, their fall would be interupted within a few feet instead of tumbling all the way to the bottom suffering certain injury and possible death.

6 Claims, 2 Drawing Sheets

STAIR GUARD

CROSS REFERENCE TO RELATED APPLICATION

The present invention relates to security and safety while actually climbing and descending staircases. While U.S. Pat. No. 4,823,524 to Bedner discloses an apparatus permanently mounted entire length of stair to hold, and U.S. Pat. No. 4,949,876 to Berner discloses a position adjustable handrail that can be extended towards existing fixed bannister if desired, neither apparatus will stop or limit one's fall if handgrip is lost. U.S. Pat. No. 5,957,146 to Corey discloses a portable bannister that the user must carry and relocate as they descend, or lift and relocate as they climb the staircase, doing so apparantly every other step. This apparatus also would not prevent an unhindered fall to the bottom in the event of a missed step, or lost handhold. While these various devices may be suitable for the particular purpose to which they address, they would not be as suitable for the purposes of the present invention as heretofore described.

BACKGROUND OF INVENTION

The present invention is the simple solution to an age old need for safety while navigating staircases. Many devices have been invented and used for the intent of preventing infants or toddlers from accessing staircases, because of the dangers associated with falls. Bannisters and handrails have been used to provide stability, safety, and an aid for the elderly, or anyone needing the security of having something to steady their travel up and down the stairs. The present invention is the manner of which a group of safety barriers, that, when installed according to recommended arrangement in and on a staircase will provide safety and stability for the person, young or old, while climbing or descending said staircase. If a person stumbles, and/or loses their handhold on a handrail or bannister, or if a toddler defeats an infant gate, their fall goes unhindered, all the way to the bottom of the staircase, usually suffering multiple bruises, broken bones, or often times, worse. This invention's purpose is primarily, in the event of an accident, to stop the person's fall within a few feet, reducing the distance fallen; and accordingly, lessening the degree of injuries incurred, if any. This invention's secondary purpose is in the support it provides as an aid in climbing, stability it affords while descending, and the reassurance of peace of mind knowing that the staircase is now a safer place to travel, even for young children.

BRIEF SUMMARY OF INVENTION

The primary object of this invention is to: If a fall occurs while navigating a staircase, limit the distance fallen and subsequently reduce the severity of injuries associated with such accidents. Another object of this invention is to offer stability when descending, and an aid when climbing the staircase when needed.

BRIEF DESCRIPTION OF SEVERAL VIEWS OF THE DRAWINGS

The accompanying drawings which are incorporated in and form a part of the specifications, illustrate the preferred embodiments as employed in manner intended, together with the descriptions, serve to explain the principles of the present invention.

IN THE DRAWINGS

Figure 1:
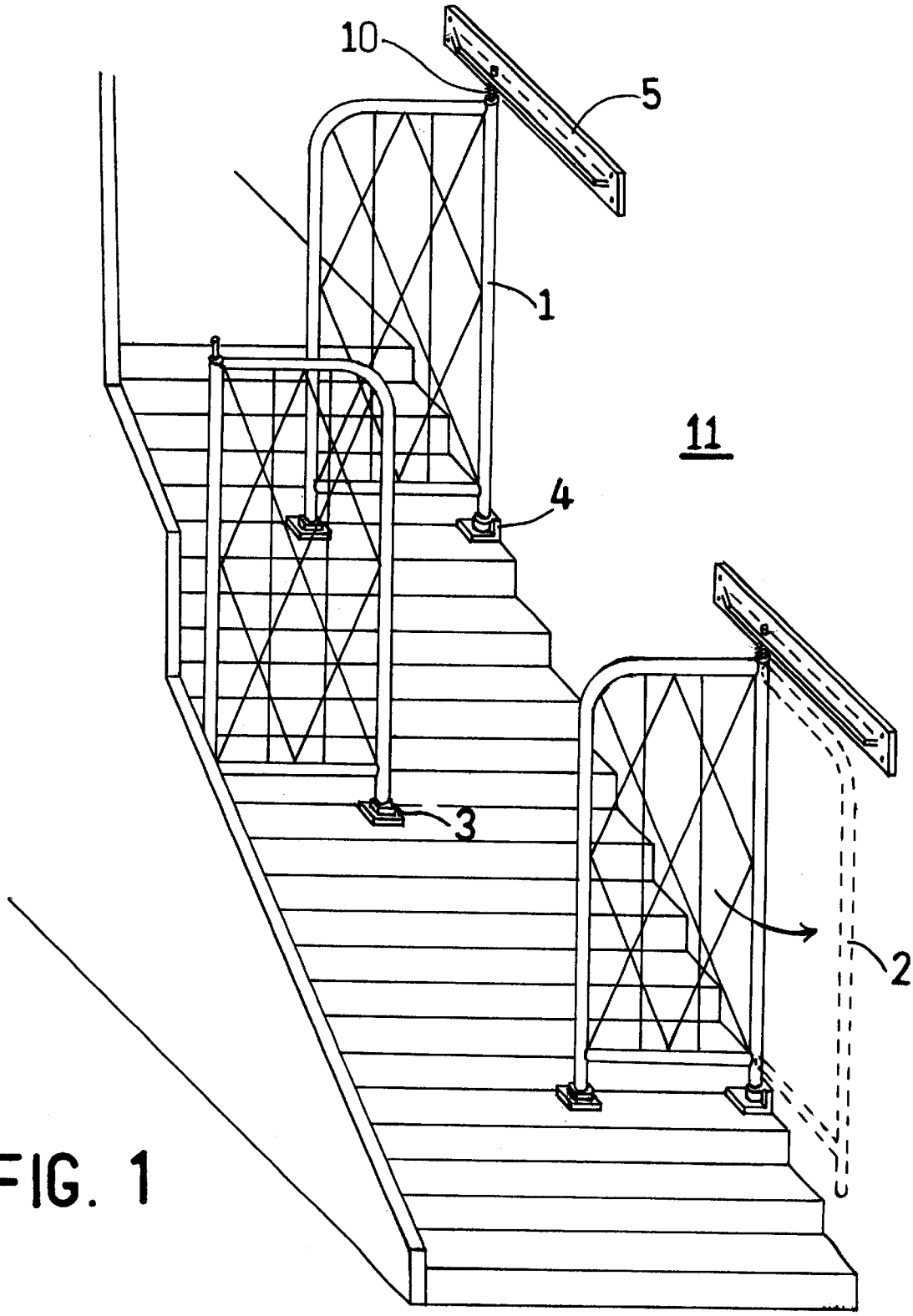

FIG. 1 is a perspective view of the intended manner for which partial barriers as embodied, installed upon a staircase in relationship to one another, achieve the purpose of the present invention.

Figure 2:
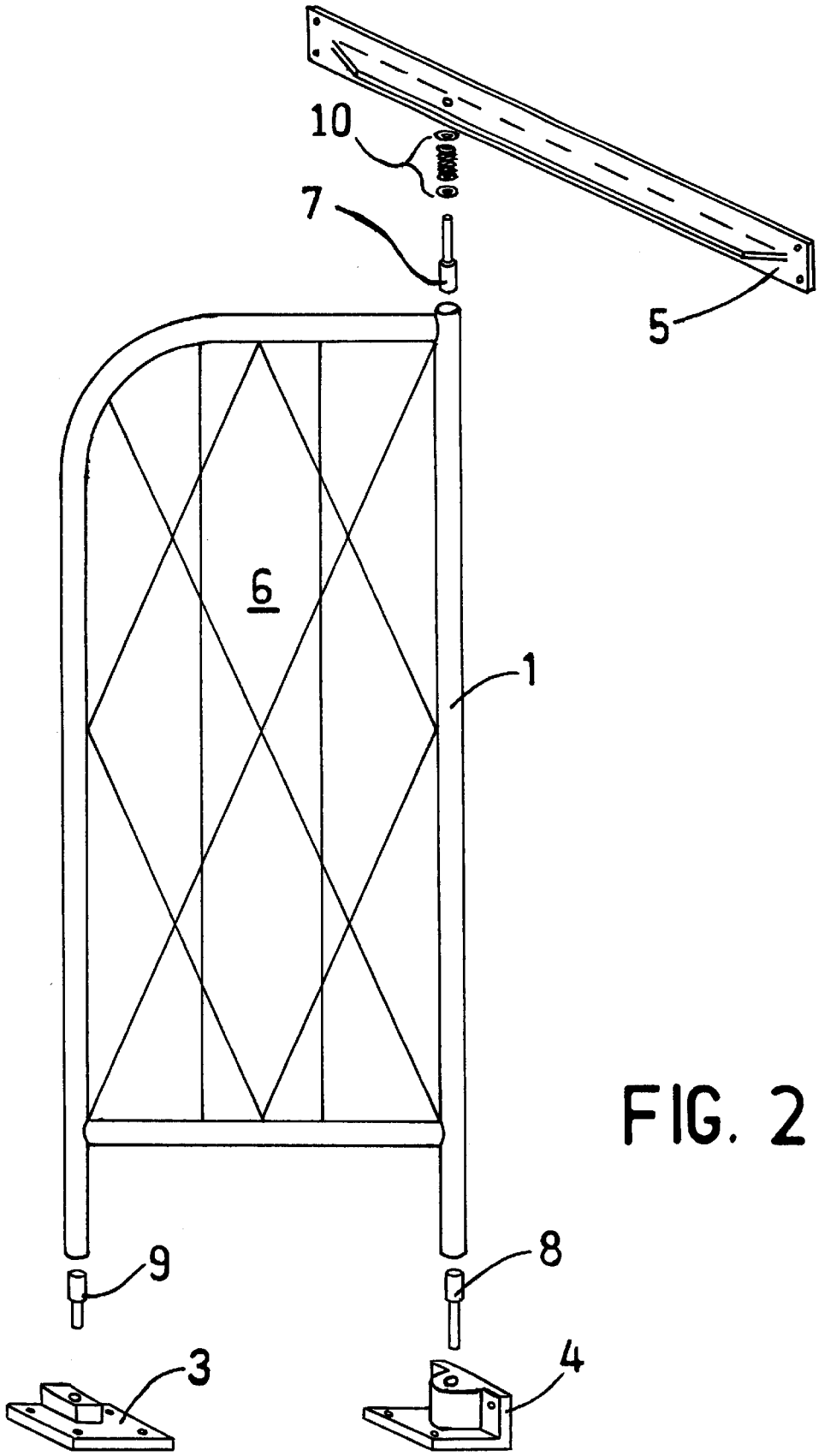

FIG. 2 is a perspective view of the preferred embodiments as conceived to achieve intended purpose of the present invention.

DETAILED DESCRIPTION OF THE INVENTION

Pivotable safety barriers 1, shown best as an assembly in FIG. 2, are illustrated in FIG. 1, in the manner for which they are intended to be installed alternately from opposing sides of a staircase extending into the centermost portion of said staircase so as to direct travel from side to side around barriers.

In FIG. 1, barriers engaging pivotably to upper support bracket 5, affixed to wall 11, and engaging pivotably to lower support bracket 4, affixed to rearmost corner of stairstep aligned perpendiculary below upper support bracket 5.

In FIG. 1, centermost lower leg of barrier 1, to engage with latch receptacle 3, affixed to rearmost horizontal position on same stairstep as lower support bracket 4, corresponding to align at centermost position with said centermost lower leg of barrier 1.

In FIG. 1 alternating barriers to be affixed to opposing walls, pivotably by upper support 5, and lower support 4, with centermost leg of frame extending into centermost portion of staircase, and staggered one above another as illustrated, spaced apart to permit travel around said barriers 1.

In FIG. 1, barriers 1, pivotable as shown 2, by exerting upward force on barrier against tension spring assembly 10, shown most clearly in FIG. 2, and dissengaging latch pin 9, also shown in FIG. 2, from latch receptacle 3, to permit said barrier to swing away to wall 11.

In FIG. 1, barriers pivoted 2, away from center of staircase and against adjacent wall 11, to permit unobstructed passage up or down staircase when needed.

A pivotable safety barrier assembly as shown in FIG. 2, consisting of the barrier frame 1, enclosed with screen or mesh 6, with latch pin 9, inserted as arm in sleeve and secured into said frame 1, as illustrated. Also consisting of bottom hinge pin 8, and top hinge pin 7, inserted as arm in sleeve and secured into corresponding positions in barrier frame 1, as illustrated. Also consisting of washers and tension spring assembly 10, appropriately installed over top hinge pin 7, where it extends out of body of barrier frame as embodied.

In FIG. 2, as an assembly, with top hinge pin 7, bottom hinge pin 8, and latch pin 9, installed in frame 1, barrier is therefore pivotably mounted via engagement of hinge pin 8, into lower support bracket 4, as arm in sleeve, and engagement of hinge pin 7, into upper support bracket 5, with washers and tension spring assembly 10, installed between top of barrier frame 1, and underside of upper support bracket 5, being affixed to vertical wall 11, perpendiculary above position of lower support bracket 4, as shown in FIG. 1.

In FIG. 1, upper support bracket 5, to be affixed to vertical wall 11, at height intended to hold slight downward force against tension spring assembly 10, through which top hinge pin 7, protrudes into corresponding hole of upper support bracket 5, as illustrated. Tension spring assembly 10, to provide downward force on barrier 1, to keep latch pin 9, engaged into latch receptacle 3, when said barrier is in closed position as embodied.

In FIG. 1, latch pin 9, as shown in FIG. 2, when barrier is in closed position 1, is engaged as arm in sleeve manner to latch receptacle 3, affixed to the centermost, rearmost horizontal plane of intended step corresponding with lower support bracket 4.

To the accomplishment of the above and foregoing related objects, this invention may be embodied in the form illustrated in the accompanying drawings, attention being called to the fact, however, that the drawings are illustrative only, and that variations in the construction are contemplated, limited only by the scope of the claims.

I claim:

1. In a protective barrier system for a staircase, said staircase having a length and width, which said barrier system includes a plurality of barriers spaced along the length of said staircase, each said barrier extending from a wall or railing adjacent the staircase toward the centermost portion of the width of said staircase, the improvement in said barriers comprising:

each said barrier having a generally rectangular frame, said frame including inner and outer vertical legs, each of said legs having an upper end and a lower end, an upper horizontal arm extending between and attached to said inner and outer vertical legs adjacent to their upper ends, a lower horizontal arm extending between and attached to said inner and outer vertical legs adjacent to their lower ends, said inner and outer vertical legs and said upper and lower horizontal arms forming the major planar surface of said barrier;

a barrier screen carried by said frame;

a top hinge pin extending from said upper end of said inner vertical leg, said top hinge pin adapted to rotatably engage an upper support bracket attached to said wall or railing;

a bottom hinge pin extending from said lower end of said inner vertical leg, said bottom hinge pin adapted to rotatably engage a lower support bracket attached to said staircase;

said barrier being pivotable between a first position where its major planar surface is substantially parallel to said wall or rail to a second position where its major planar surface is substantially perpendicular to said wall or rail; and a latch pin extending from said lower end of said outer vertical leg, a latch receptacle attached to said staircase and adapted to engage said latch pin in locking engagement upon said barrier being pivoted from said first position to said second position and to disengage said latch pin from locking engagement when said barrier is pivoted from said second position to said first position.

2. The protective barrier system of claim 1 wherein said upper and lower support brackets are substantially in vertical alignment.

3. The protective barrier system of claim 1 wherein said top hinge pin includes a tension spring assembly installed thereabout, said tension spring assembly adapted to push downwardly on said frame to thereby cause said latch pin to remain in locking engagement with said latch receptacle when said latch pin and latch receptacle are in alignment, and adapted to be compressible upon manual upward movement of said frame to thereby release said latch pin from locking engagement with said latch receptacle.

4. In a protective barrier system for a staircase, said staircase having a length and width, which said barrier system includes a plurality of barriers spaced along the length of said staircase with adjacent barriers being located on opposite sides of the staircase in a staggered configuration, each said barrier extending from a wall or railing adjacent the staircase toward the centermost portion of the width of said staircase, the improvement in said barriers comprising:

each said barrier having a generally rectangular frame, said frame including inner and outer vertical legs, each of said legs having an upper end and a lower end, an upper horizontal arm extending between and attached to said inner and outer vertical legs adjacent to their upper ends, a lower horizontal arm extending between and attached to said inner and outer vertical legs adjacent to their lower ends, said inner and outer vertical legs and said upper and lower horizontal arms forming the major planar surface of said barrier;

a barrier screen carried by said frame;

a top hinge pin extending from said upper end of said inner vertical leg, said top hinge pin adapted to rotatably engage an upper support bracket attached to said wall or railing;

a bottom hinge pin extending from said lower end of said inner vertical leg, said bottom hinge pin adapted to rotatably engage a lower support bracket attached to said staircase;

said barrier being pivotable between a first position where its major planar surface is substantially parallel to said wall or rail to a second position where its major planar surface is substantially perpendicular to said wall or rail; and a latch pin extending from said lower end of said outer vertical leg, a latch receptacle attached to said staircase and adapted to engage said latch pin in locking engagement upon said barrier being pivoted from said first position to said second position and to disengage said latch pin from locking engagement when said barrier is pivoted from said second position to said first position.

5. The protective barrier system of claim 4 wherein said upper and lower support brackets are substantially in vertical alignment.

6. The protective barrier system of claim 4 wherein said top hinge pin includes a tension spring assembly installed thereabout, said tension spring assembly adapted to push downwardly on said frame to thereby cause said latch pin to remain in locking engagement with said latch receptacle when said latch pin and latch receptacle are in alignment, and adapted to be compressible upon manual upward movement of said frame to thereby release said latch pin from locking engagement with said latch receptacle.

* * * * *